US012595597B2

(12) United States Patent
Kaing et al.

(10) Patent No.: US 12,595,597 B2
(45) Date of Patent: Apr. 7, 2026

(54) FLEXIBLE, HIGH TEMPERATURE RESISTANT, FLUID RESISTANT, ABRASION RESISTANT, MULTILAYERED WRAPPABLE TEXTILE SLEEVE AND METHOD OF CONSTRUCTION THEREOF

(71) Applicant: Systems Protection Group US LLC, Northville, MI (US)

(72) Inventors: Alice Kaing, Margny-les-Compiegne (FR); Melanie Veronneau, Borest (FR); Amelie Simoens, Compiegne (FR); Michael Horckmans, Etavigny (FR); Julien Deltor, Arges (RO)

(73) Assignee: Systems Protection Group US LLC, Northville, MI (US)

( * ) Notice: Subject to any disclaimer, the term of this patent is extended or adjusted under 35 U.S.C. 154(b) by 379 days.

(21) Appl. No.: 18/122,499

(22) Filed: Mar. 16, 2023

(65) Prior Publication Data

US 2023/0295844 A1 Sep. 21, 2023

Related U.S. Application Data

(60) Provisional application No. 63/321,314, filed on Mar. 18, 2022.

(51) Int. Cl.

| | |
|---|---|
| ***D03D 1/00*** | (2006.01) |
| ***D01F 9/22*** | (2006.01) |
| ***D03D 3/02*** | (2006.01) |
| ***D03D 11/02*** | (2006.01) |
| ***D03D 15/242*** | (2021.01) |

(Continued)

(52) U.S. Cl.

CPC ..... *D03D 1/0043* (2021.05); *D01F 9/22* (2013.01); *D03D 3/02* (2013.01); *D03D 11/02* (2013.01); *D03D 15/247* (2021.01); *D03D 15/267* (2021.01); *D03D 15/497* (2021.01); *D03D 15/513* (2021.01); *D06M 15/643* (2013.01); *D10B 2101/08* (2013.01)

(58) Field of Classification Search

None

See application file for complete search history.

(56) References Cited

U.S. PATENT DOCUMENTS

| | | | |
|---|---|---|---|
| 10,627,019 | B1 | 4/2020 | Franklin |
| 2002/0170727 | A1 | 11/2002 | Holland et al. |

(Continued)

FOREIGN PATENT DOCUMENTS

| | | | |
|---|---|---|---|
| CN | 102136318 | A | 7/2011 |
| CN | 106887278 | A | 6/2017 |

(Continued)

*Primary Examiner* — Shawn Mckinnon

(74) *Attorney, Agent, or Firm* — John D. Wright; Dickinson Wright PLLC

(57) ABSTRACT

A wrappable sleeve for routing and protecting an elongate member, against exposure to high temperature, abrasion, fluid ingress, and contamination, has a multilayered wall extending widthwise between opposite edges and extending lengthwise along a longitudinal axis between opposite ends. The wall includes a textile outer layer, a textile inner layer, and an intermediate layer sandwiched between the outer layer and the inner layer. The intermediate layer includes a textile intermediate layer facing the textile inner layer and a silicone-based layer facing the textile outer layer.

20 Claims, 2 Drawing Sheets

(51) Int. Cl.

| | |
|---|---|
| ***D03D 15/267*** | (2021.01) |
| ***D03D 15/40*** | (2021.01) |
| ***D03D 15/513*** | (2021.01) |
| ***D06M 15/643*** | (2006.01) |

(56) References Cited

U.S. PATENT DOCUMENTS

| | | | | |
|---|---|---|---|---|
| 2014/0356564 | A1* | 12/2014 | Yamaguchi | H02G 3/0481 428/36.1 |
| 2016/0264328 | A1* | 9/2016 | Barger | H02G 3/32 |
| 2020/0203939 | A1* | 6/2020 | Gooding | H02G 9/08 |
| 2020/0328010 | A1 | 10/2020 | Liao | |

FOREIGN PATENT DOCUMENTS

| | | | |
|---|---|---|---|
| CN | 108461196 | A | 8/2018 |
| CN | 209071986 | U | 7/2019 |
| CN | 110504058 | A | 11/2019 |
| CN | 111739687 | A | 10/2020 |
| DE | 102007027226 | A1 | 12/2008 |
| EP | 0886357 | A2 | 12/1998 |
| EP | 0886358 | B1 | 5/2003 |
| EP | 1217704 | B1 | 6/2006 |
| EP | 1847638 | A2 | 10/2007 |
| WO | 2019231946 | A1 | 12/2019 |
| WO | 2021055381 | A1 | 3/2021 |

* cited by examiner

FIG. 1
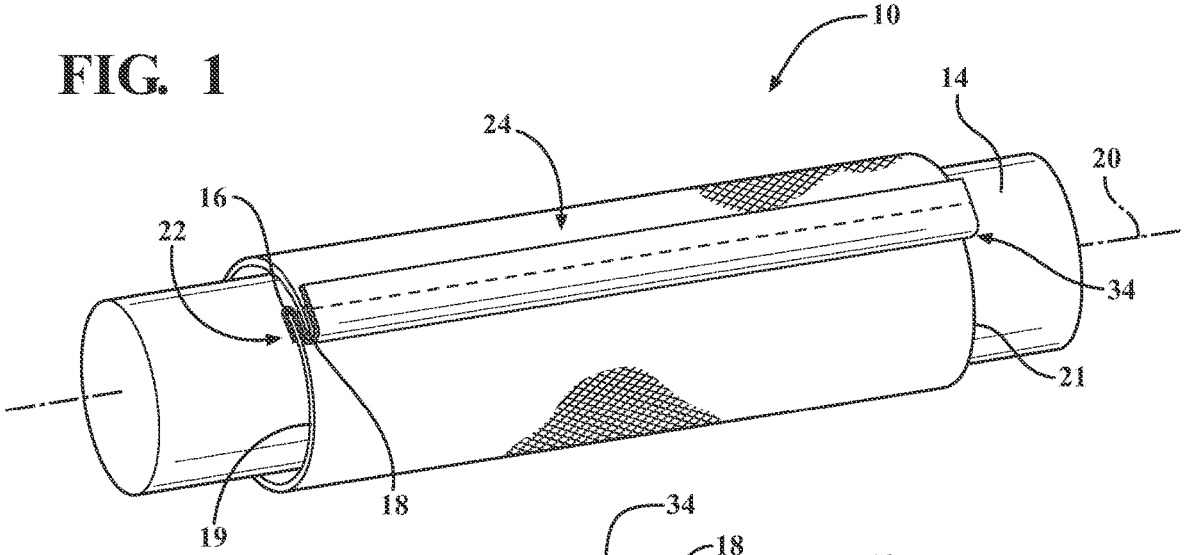
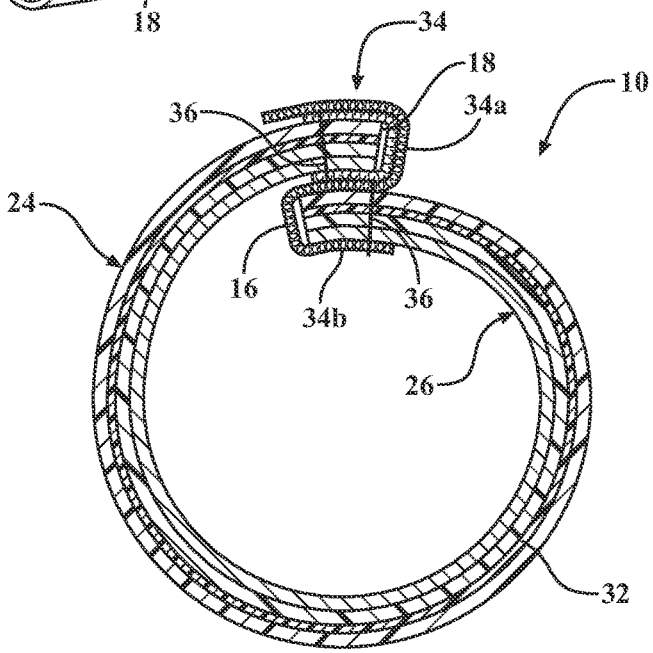
FIG. 1A
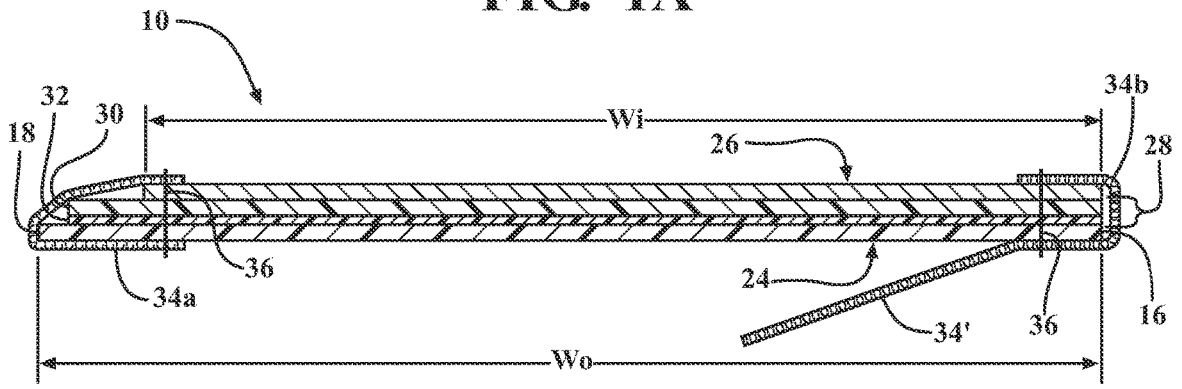
FIG. 2

FLEXIBLE, HIGH TEMPERATURE RESISTANT, FLUID RESISTANT, ABRASION RESISTANT, MULTILAYERED WRAPPABLE TEXTILE SLEEVE AND METHOD OF CONSTRUCTION THEREOF

CROSS-REFERENCE TO RELATED APPLICATION

This application claims the benefit of U.S. Provisional Application Ser. No. 63/321,314, filed Mar. 18, 2022, which is incorporated herein by reference in its entirety.

BACKGROUND OF THE INVENTION

1. Technical Field

This invention relates generally to flexible textile sleeves for protecting elongate members, and more particularly to high temperature resistant, fluid resistant, and abrasion resistant wrappable textile sleeves.

2. Related Art

It is known to contain and protect elongate members, such as wires and wire harnesses, for example, in circumferentially continuous or wrappable textile sleeves to provide protection to the cables, wires, and hoses. Circumferentially continuous sleeve are generally challenging to assemble about elongate members to be protected due to their having a fixed cavity size and to having to be slipped axially over the elongate member to be protected. Both circumferentially continuous and wrappable sleeves exhibit shortcomings in being able to provide protection against damage to data transmission members, such as wires, contained within the sleeves when exposed to high temperatures, including temperatures encountered with fire, for an extended period of time, such as 30 minutes or more, and in some cases, up to 2 hours or more.

SUMMARY OF THE INVENTION

One aspect of the invention provides a wrappable sleeve for routing and protecting an elongate member from damage due to exposure to high temperatures, including temperatures encountered in fire for an extended period of time, including up to 2 hours or more, against abrasion, fluid ingress, and other environmental conditions, such as contamination. The wrappable sleeve has a multilayered wall extending widthwise between opposite edges and extending lengthwise along a longitudinal axis between opposite ends. The wall includes a textile outer layer, a textile inner layer, and an intermediate layer sandwiched between the outer layer and the inner layer. The intermediate layer includes a textile layer facing the textile inner layer and a silicone-based intermediate layer facing the textile outer layer.

In accordance with another aspect of the invention, a closure member is fixed to the wall, wherein the closure member is configured to releasably fix the opposite edges in overlapping relation with one another to provided circumferentially continuous protection about the entire circumference of the elongate member being protected.

In accordance with another aspect of the invention, the closure member can be provided as a hook-and-loop type fastener, with hooks being fixed along one of the opposite edges and loops being fixed along the other of the opposite edges.

In accordance with another aspect of the invention, the textile outer layer can be provided as a woven, braided or knit layer.

In accordance with another aspect of the invention, the woven, braided or knit outer layer can be formed with high temperature resistant yarns.

In accordance with another aspect of the invention, the high temperature resistant yarns forming the outer layer can be provided as ceramic yarns.

In accordance with another aspect of the invention, the textile inner layer can be provided as a woven, braided or knit layer.

In accordance with another aspect of the invention, the woven, braided or knit inner layer can be formed with high temperature resistant yarns.

In accordance with another aspect of the invention, the high temperature resistant yarns forming the inner layer can be provided as yarns formed of an oxidized polyacrylonitrile fiber (preox or panox (PAN)).

In accordance with another aspect of the invention, the textile layer of the intermediate layer can be woven, braided or knit layer from high temperature yarns.

In accordance with another aspect of the invention, the high temperature resistant yarns forming the textile layer of the intermediate layer can be provided as fiberglass yarns.

In accordance with another aspect of the invention, the thickness of the wall can be provided being about 10 mm or less.

In accordance with another aspect of the invention, a width of the inner layer can be provided being less that a width of the outer layer to facilitate wrapping the opposite edges into overlapping relation with one another with causing wrinkles or folds in the wall.

In accordance with another aspect of the invention, the wall can be formed to provide an internal temperature within a cavity bounded by the wall of about 200° C. or less when exposed to a flame of about 1100° C. for up to 2 hours, and to provide an internal temperature within the cavity bounded by the wall of about 140° C. or less when exposed to a flame of about 850° C. for up to 2 hours.

In accordance with another aspect of the invention, the textile outer layer, textile inner layer, and intermediate layer can be stitched to one another via a high temperature resistant yarn.

In accordance with another aspect of the invention, the high temperature resistant yarn can be stitched adjacent both opposite ends of the wall to fix the textile outer layer, the textile inner layer, and the intermediate layer to one another.

In accordance with another aspect of the invention, a textile sleeve for routing and protecting an elongate member consists of: a multilayered wall extending widthwise between opposite edges and extending lengthwise along a longitudinal axis between opposite ends, the multilayered wall including a textile outer layer, a textile inner layer, and an intermediate layer sandwiched between the outer layer and the inner layer. The intermediate layer includes a textile intermediate layer facing the textile inner layer and a silicone-based layer facing the textile outer layer. A closure member is fixed to the wall. The closure member is configured to releasably fix the opposite edges against separation from one another to provided circumferentially continuous protection about the elongate member being protected.

In accordance with another aspect of the invention, a method of constructing a wrappable sleeve for routing and protecting an elongate member includes interlacing yarns to form a textile outer layer; interlacing yarns to form a textile inner layer, and forming an intermediate layer by interlacing yarns to form a textile intermediate layer and fixing a silicone-based layer to the textile intermediate layer. Further, forming a multilayered wall by fixing the textile inner layer to the intermediate layer with the textile intermediate layer facing the textile inner layer, and fixing the textile outer layer to the intermediate layer with the silicone-based intermediate layer facing the textile outer layer. Further yet, cutting the multilayered wall to length, with the multilayered wall having opposite edges extending lengthwise between opposite ends.

In accordance with another aspect of the invention, the method can further include fixing the silicone-based layer to the textile intermediate layer by bonding the silicone-based layer to the textile intermediate layer.

In accordance with another aspect of the invention, the method can further include fixing the textile inner layer to the intermediate layer and fixing the textile outer layer to the intermediate layer by sandwiching the intermediate layer between the textile inner layer and the textile outer layer and stitching a high temperature yarn through the textile inner layer, the intermediate layer and the textile outer layer.

In accordance with another aspect of the invention, the method can further include providing the yarns for the textile inner layer including oxidized polyacrylonitrile fibers and providing the yarns for the textile outer layer including ceramic yarns.

In accordance with another aspect of the invention, the method can further include fixing a closure member to the multilayered wall, and configuring the closure member to releasably fix the opposite edges against separation from one another to provided circumferentially continuous protection about the elongate member being protected.

BRIEF DESCRIPTION OF THE DRAWINGS

These and other aspects, features and advantages will become readily apparent to those skilled in the art in view of the following detailed description of presently preferred embodiments and best mode, appended claims, and accompanying drawings, in which:

FIG. 1 is schematic perspective view of a wrappable sleeve constructed in accordance with one aspect of the invention, with the wrappable sleeve shown wrapped about an elongate member to be protected therein;

FIG. 1A is a photographic perspective end view of the sleeve of FIG. 1;

FIG. 2 is a schematic end view looking along a longitudinal axis of the wrappable sleeve while a wall of the wrappable sleeve is in an unwrapped state;

DETAILED DESCRIPTION OF PREFERRED EMBODIMENTS

Figure 2A:
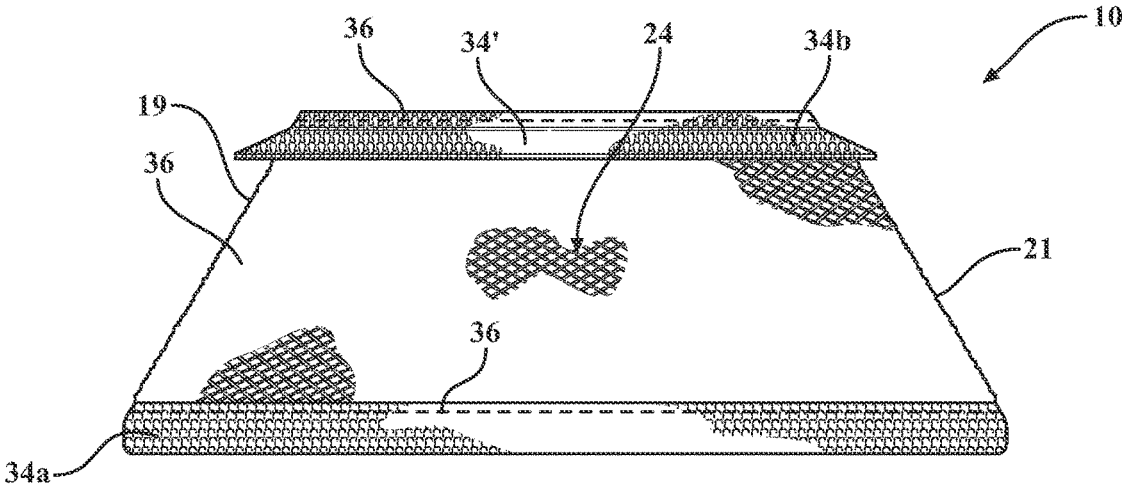
FIG. 2A is a photographic top perspective view of the wrappable wall of the sleeve of FIG. 1A while the wall of the sleeve is in an unwrapped state.
Figure 2B:
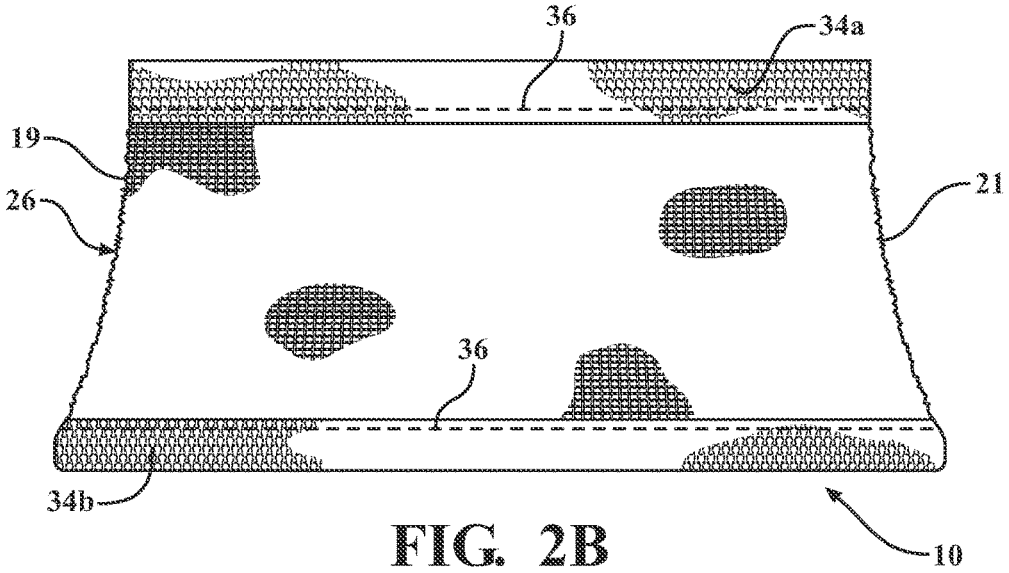
FIG. 2B is a photographic bottom perspective view of the wrappable wall of the sleeve of FIG. 1A while the wall of the sleeve is in an unwrapped state.

Referring in more detail to the drawings, FIGS. 1 and 2 show a schematic representation of a wrappable (shown wrapped in FIG. 1 and unwrapped in FIG. 2) textile sleeve, referred to hereafter as sleeve 10, constructed in accordance with an aspect of the invention, while FIGS. 1A, 2A and 2B show photographs of the sleeve 10 in accordance with an aspect of the invention. The sleeve 10 has a flexible, wrappable elongate wall 12 for routing and protecting an elongate member(s) 14, such as a data conveying member, including a cable or wires, for example, from exposure to high temperatures, including temperatures of about 1100° C. encountered from direct exposure to fire for an extended period of time, including up to about 2 hours or more, abrasion, fluid absorption and ingress, and other environmental conditions, such as contamination. The wall 12 can be constructed having any suitable size, including length and diameter. The thickness of the wall 12 can be provided being about 10 mm or less.

The wall 12 extends widthwise between opposite edges 16, 18 and lengthwise between opposite ends 19, 21. The opposite edges 16, 18 extend generally parallel to a central, longitudinal axis 20, wherein the edges 16, 18 are wrappable into overlapping relation with one another in "cigarette wrapped" fashion to fully enclose the elongate member 14 within a central cavity 22 bounded by the inner surface 15 of the sleeve 10. The wall 12 includes a textile outer layer 24, a textile inner layer 26, and an intermediate layer 28 sandwiched between the outer layer 24 and the inner layer 26. The intermediate layer 28 includes an intermediate textile layer 30 facing the textile inner layer 26 and a silicone-based layer 32 facing the textile outer layer 24. In the embodiment illustrated, the intermediate textile layer 30 is in direct abutting relation with the textile inner layer 26, and can be fixed thereto, and a silicone-based layer 32 is in direct abutting relation with the textile outer layer 24, and can be fixed thereto. To releasably maintain the sleeve 10 in a protective, fixed position about the elongate member 14, a closure member 34 is fixed to the wall 12, wherein the closure member 34 is configured to releasably fix the opposite edges 16, 18 against separation from one another, and in the embodiment illustrated, in overlapping relation with one another, to provided circumferentially continuous protection about the entire circumference of the elongate member 14 being protected.

The closure member 34 can be provided as a hook-and-loop type fastener, with hooks of a hook portion 34*a* being fixed along one of the opposite edges 16 or 18, and loops of a loop portion 34*b* being fixed along the other of the opposite edges 16 or 18. The hook and loop portions, 34*a*, 34*b* can extend along the entire length of the wall 12, and can be fixed to the wall 12 via any desired mechanism, including being fixed thereto via high temperature resistant stitched yarn and/or a high temperature adhesive, by way of example and without limitation. In accordance with one non-limiting embodiment, the textile outer layer 24, the textile inner layer 26, the intermediate layer 28 can be stitched to one another via a high temperature resistant yarn 36 used to stitch the hook portion 34*a* and the loop portion 34*b* to the wall 12. Accordingly, the high temperature resistant yarn 36 can be stitched along and adjacent both opposite edges 16, 18 of the wall 12 to fix the textile outer layer 24, the textile inner layer 26, and the intermediate layer 28 to one another, with the hook portion 34*a* extending along one of the edges 16, 18 and the loop portion 34*b* extending along the other of the edges 16, 18. Further, the outer layer 24, the textile inner layer 26, and the intermediate layer 28 can remain detached from one another along the opposite ends 19, 21, thereby allowing the respective layers 24, 26, 28 to shift circumferentially relative to one another while being wrapped, thus, avoiding unsightly and undesirable folds/ridges being formed between the layers 24, 26, 28.

The hook portion 34*a* and the loop portion 34*b* can be configured to maintain the opposite edges 16, 18 in overlapped relation with one another in such a manner that circumferentially continuous protection is provided about the central cavity 22. In the illustrated non-limiting embodiment, the hook portion 34*a* is fixed about one of the edges, shown as the radially outermost edge 18, while the loop portion 34*b* is fixed about the other of the edges, shown as the radially innermost edge 16. The hook portion 34*a* is shown as being generally U-shaped in cross-section, as viewed in FIGS. 1A and 2, with opposite legs of the U-shape extending along and being fixed to an inner face defined by the inner layer 26 and an outer face defined by the outer layer 24 via the stitched yarn 36, with an intermediate portion extending between the legs extending radially along the edge 18. The entirety of the hook portion 34*a* is fixed against separation from the wall 12. The loop portion 34*b* is shown having a generally U-shaped portion, as viewed in cross-section in FIGS. 1A and 2, with opposite legs of the U-shape extending along and being fixed to the inner face defined by the inner layer 26 and the outer face defined by the outer layer 24 via the stitched yarn 36, with an intermediate portion extending between the legs extending radially along the edge 20. However, unlike the hook portion 34*a*, the loop portion 34*b*, as best shown in FIG. 2, has a free portion 34' extending in detached fashion from the wall 12, shown as extending from the stitched yarn 36 in detached relation outwardly from a radially outwardly facing surface of the outer layer 24. In assembly, the outer edge 18, with hook portion 34*a* attached thereto, is wrapped over the inner edge 16, with loop portion 34*b* fixed thereto, wherein a radially inwardly facing portion of the hook portion 34*a* is brought into fixed attachment with a radially outwardly facing portion of the loop portion 34*b*. Then, the free portion 34' of loop portion 34*b* is wrapped over a radially outward facing portion of the hook portion 34*a* into fixed attachment therewith. As such, upon the loop portion 34*b* being fully fixed to the hook portion 34*a*, the loop portion 34*b*, as viewed in FIG. 1A, is generally S-shaped, with the hook portion 34*a* being sandwiched and captured in fixed relation between portions of the loop portion 34*b* to provide secure, circumferentially continuous protection against thermal effects and the ingress of contamination.

Figure 3A:
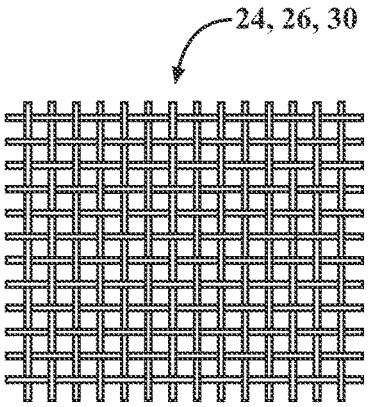
FIGS. 3A-3C illustrate different embodiments of interlaced textile layers of an outer layer, an inner layer, and a portion of an intermediate layer the wall of the wrappable sleeve of FIG. 1.
Figure 3B:
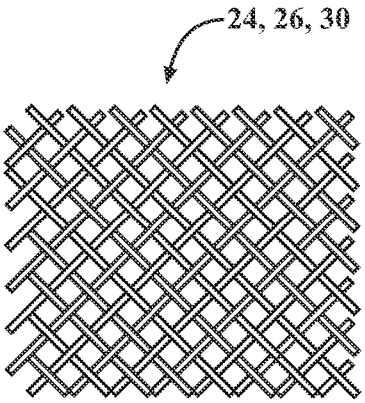
Figure 3C:
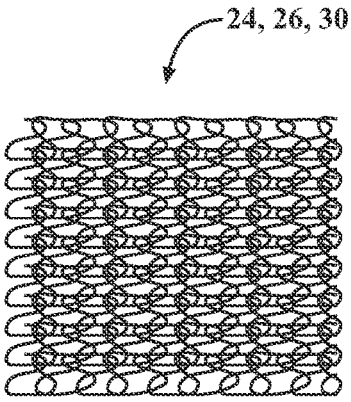

The textile outer layer 24 can be provided as a woven, braided or knit layer (FIGS. 3A-3C). The woven, braided or knit outer layer 24 can be formed with high temperature resistant yarns, such as ceramic yarns, by way of example and without limitation. In one exemplary embodiment, a layer of ceramic material of Nextel from 3M was used.

The textile inner layer 26 can be provided as a woven, braided or knit layer. The woven, braided or knit inner layer 26 can be formed with high temperature resistant yarns, such as yarns formed of an oxidized polyacrylonitrile fiber (preox or panox (PAN)), by way of example and without limitation. In accordance with one non-limiting embodiment, the inner layer 26 is knit.

The intermediate textile layer 30 can be woven, braided or knit layer from high temperature yarns. In the non-limiting embodiment illustrated, the intermediate textile layer 30 is braided from fiberglass.

A first width (Wi) of the inner layer 26 can be provided being less that a second width (Wo) of the outer layer 24, as best shown in FIG. 2, to facilitate wrapping the opposite edges 16, 18 into overlapping relation with one another with causing wrinkles or folds in the wall 12.

The synergies provided by the outer layer 24, inner layer 26, and intermediate layer 28 of the wall 12, as discussed above, can be formed to limit an internal temperature within the cavity 22 bounded by the wall 12 to about 200° C. or less when exposed to a flame of about 1100° C. for up to 2 hours, and to limit an internal temperature within the cavity bounded by the wall to about 140° C. or less when exposed to a flame of about 850° C. for up to 2 hours.

In accordance with another aspect of the disclosure, a method of constructing a wrappable sleeve 10, as discussed above, for routing and protecting an elongate member 14 is provided. The method includes interlacing yarns to form a textile outer layer 24; interlacing yarns to form a textile inner layer 26, and forming an intermediate layer 28 by interlacing yarns to form a textile intermediate layer 30 and fixing a silicone-based layer 32 to the textile intermediate layer 30. Further, forming a multilayered wall 12 by fixing the textile inner layer 26 to the intermediate layer 28 with the textile intermediate layer 30 facing the textile inner layer 26, and fixing the textile outer layer 24 to the intermediate layer 28 with the silicone-based intermediate layer 32 facing the textile outer layer 24. Further yet, cutting the multilayered wall 12 to length, with the multilayered wall 12 having opposite edges 16, 18 extending lengthwise between opposite ends 19, 21.

The method can further include fixing the silicone-based layer 32 to the textile intermediate layer 30 by bonding the silicone-based layer 32 to the textile intermediate layer 30.

The method can further include fixing the textile inner layer 26 to the intermediate layer 28 and fixing the textile outer layer 24 to the intermediate layer 28 by sandwiching the intermediate layer 28 between the textile inner layer 26 and the textile outer layer 24 and stitching a high temperature yarn 36 through the textile inner layer 26, the intermediate layer 28 and the textile outer layer 24.

The method can further include providing the yarns for the textile inner layer 26 including oxidized polyacrylonitrile fibers and providing the yarns for the textile outer layer 24 including ceramic yarns.

The method can further include fixing a closure member 34 to the multilayered wall 12, and configuring the closure member 34 to releasably fix the opposite edges 16, 18 against separation from one another to provided circumferentially continuous protection about the elongate member 14 being protected.

Obviously, many modifications and variations of the present invention are possible in light of the above teachings. It is contemplated that all features of all claims and of all embodiments can be combined with each other, so long as such combinations would not contradict one another. It is, therefore, to be understood that within the scope of the appended claims, the invention may be practiced otherwise than as specifically described.

What is claimed is:

1. A textile sleeve for routing and protecting an elongate member, comprising:

a multilayered wall extending widthwise between opposite edges and extending lengthwise along a longitudinal axis between opposite ends, the wall including a textile outer layer, a textile inner layer, and an intermediate layer sandwiched between the outer layer and the inner layer, the intermediate layer includes a textile intermediate layer abutting the textile inner layer and a silicone-based intermediate layer abutting the textile outer layer.

2. The textile sleeve of claim 1, further including a closure member fixed to the wall, the closure member being configured to releasably fix the opposite edges against separation from one another to provide circumferentially continuous protection about the elongate member being protected.

3. The textile sleeve of claim 2, wherein the closure member includes a hook-and-loop type fastener, with a hook portion being fixed along one of the opposite edges and a loop portion being fixed along the other of the opposite edges.

4. The textile sleeve of claim 1, wherein the textile inner layer is formed of yarns including oxidized polyacrylonitrile fibers.

5. The textile sleeve of claim 4, wherein the textile inner layer is knit.

6. The textile sleeve of claim 4, wherein the textile outer layer is formed of ceramic yarns.

7. The textile sleeve of claim 6, wherein the textile outer layer is woven.

8. The textile sleeve of claim 6, wherein the textile intermediate layer is formed of fiberglass yarns.

9. The textile sleeve of claim 8, wherein the textile intermediate layer is braided.

10. The textile sleeve of claim 1, wherein the textile outer layer is formed of ceramic yarns.

11. The textile sleeve of claim 1, wherein the textile intermediate layer is formed of fiberglass yarns.

12. The textile sleeve of claim 1, wherein the textile outer layer, the textile inner layer, and the textile intermediate layer are stitched to one another via a high temperature resistant yarn.

13. The textile sleeve of claim 1, wherein the textile inner layer has a first width and the textile outer layer has a second width, the first width being less than the second width.

14. The textile sleeve of claim 1, wherein the multilayered wall limits an internal temperature within the cavity to about 200° C. or less when exposed to a flame of about 1100° C. for up to 2 hours, and limits an internal temperature within the cavity to about 140° C. or less when exposed to a flame of about 850° C. for up to 2 hours.

15. A textile sleeve for routing and protecting an elongate member, consisting of:

a multilayered wall extending widthwise between opposite edges and extending lengthwise along a longitudinal axis between opposite ends, the wall including a textile outer layer, a textile inner layer, and an intermediate layer sandwiched between the outer layer and the inner layer, the intermediate layer including a textile intermediate layer abutting the textile inner layer and a silicone-based layer abutting the textile outer layer; and a closure member fixed to the wall, the closure member being configured to releasably fix the opposite edges against separation from one another to provide circumferentially continuous protection about the elongate member being protected.

16. A method of constructing a textile sleeve for routing and protecting an elongate member, comprising:

interlacing yarns to form a textile outer layer;

interlacing yarns to form a textile inner layer;

forming an intermediate layer by interlacing yarns to form a textile intermediate layer and fixing a silicone-based layer to the textile intermediate layer;

forming a multilayered wall by fixing the textile inner layer to the intermediate layer with the textile intermediate layer abutting the textile inner layer, and fixing the textile outer layer to the intermediate layer with the silicone-based intermediate layer abutting the textile outer layer; and cutting the multilayered wall to length, with the multilayered wall having opposite edges extending lengthwise between opposite ends.

17. The method of claim 16, further including fixing the silicone-based layer to the textile intermediate layer by bonding the silicone-based layer to the textile intermediate layer.

18. The method of claim 17, further including fixing the textile inner layer to the intermediate layer and fixing the textile outer layer to the intermediate layer by sandwiching the intermediate layer between the textile inner layer and the textile outer layer and stitching a high temperature yarn through the textile inner layer, the intermediate layer and the textile outer layer.

19. The method of claim 16, further including providing the yarns for the textile inner layer including oxidized polyacrylonitrile fibers and providing the yarns for the textile outer layer including ceramic yarns.

20. The method of claim 16, further including fixing a closure member to the multilayered wall, the closure member being configured to releasably fix the opposite edges against separation from one another to provide circumferentially continuous protection about the elongate member being protected.

* * * * *